US005785275A

United States Patent [19]

Hiebl

[11] Patent Number: 5,785,275

[45] Date of Patent: Jul. 28, 1998

[54] MISSILE WEAPONS SYSTEM

[75] Inventor: Manfred Hiebl, Sauerlach, Germany

[73] Assignee: Daimler-Benz Aerospace AG, Ottobrunn, Germany

[21] Appl. No.: 758,144

[22] Filed: Nov. 25, 1996

[30] Foreign Application Priority Data

Dec. 9, 1995 [DE] Germany ..... 195 46 017.0

[51] Int. Cl.[6] ..... F41G 7/20

[52] U.S. Cl. ..... 244/3.17; 244/3.16

[58] Field of Search ..... 244/3.11, 3.12, 244/3.13, 3.15, 3.16, 3.17; 89/41.06

[56] References Cited

U.S. PATENT DOCUMENTS

| | | | |
|---|---|---|---|
| H796 | 7/1990 | Miller, Jr. et al. | 244/3.17 |
| 3,923,273 | 12/1975 | Alpers | 244/3.16 |
| 3,986,682 | 10/1976 | Dryden . | |
| 4,162,775 | 7/1979 | Voles | 244/3.17 |
| 5,274,236 | 12/1993 | Pascale et al. | 250/334 |
| 5,323,987 | 6/1994 | Pinson | 244/3.16 |
| 5,341,142 | 8/1994 | Reis et al. | 342/64 |

FOREIGN PATENT DOCUMENTS

| | | | |
|---|---|---|---|
| 22 43 590 B2 | 9/1976 | Germany . | |
| 33 34 729 A1 | 4/1985 | Germany . | |
| 2148465 | 5/1985 | United Kingdom | 244/3.17 |

*Primary Examiner*—Charles T. Jordan
*Assistant Examiner*—Christopher K. Montgomery
*Attorney, Agent, or Firm*—McGlew and Tuttle

[57] ABSTRACT

A missile weapons system with a homing head optical system and an alignment processor, in which the visual field of the homing head is adjusted to the size of the target by handing over the target marking frame size to the homing head, which is equipped with a zoom lens, and the effect of parallax on the correlation is eliminated.

2 Claims, 2 Drawing Sheets

FIGURE 1A
FIGURE 1B
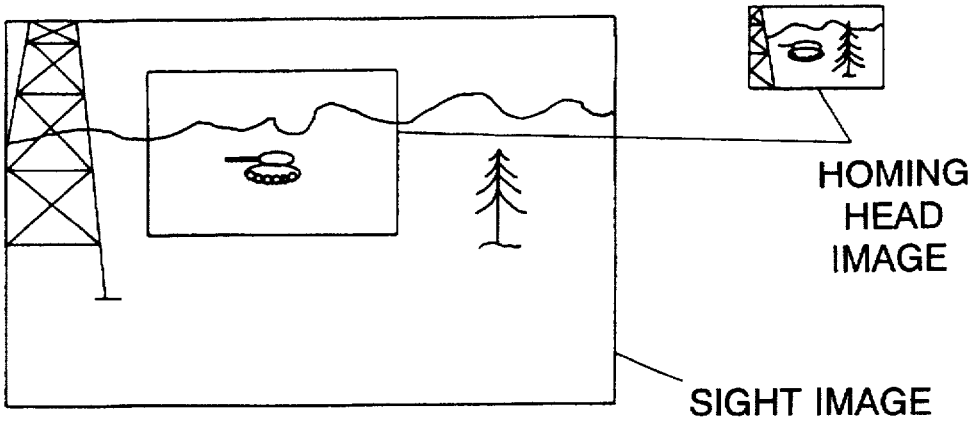
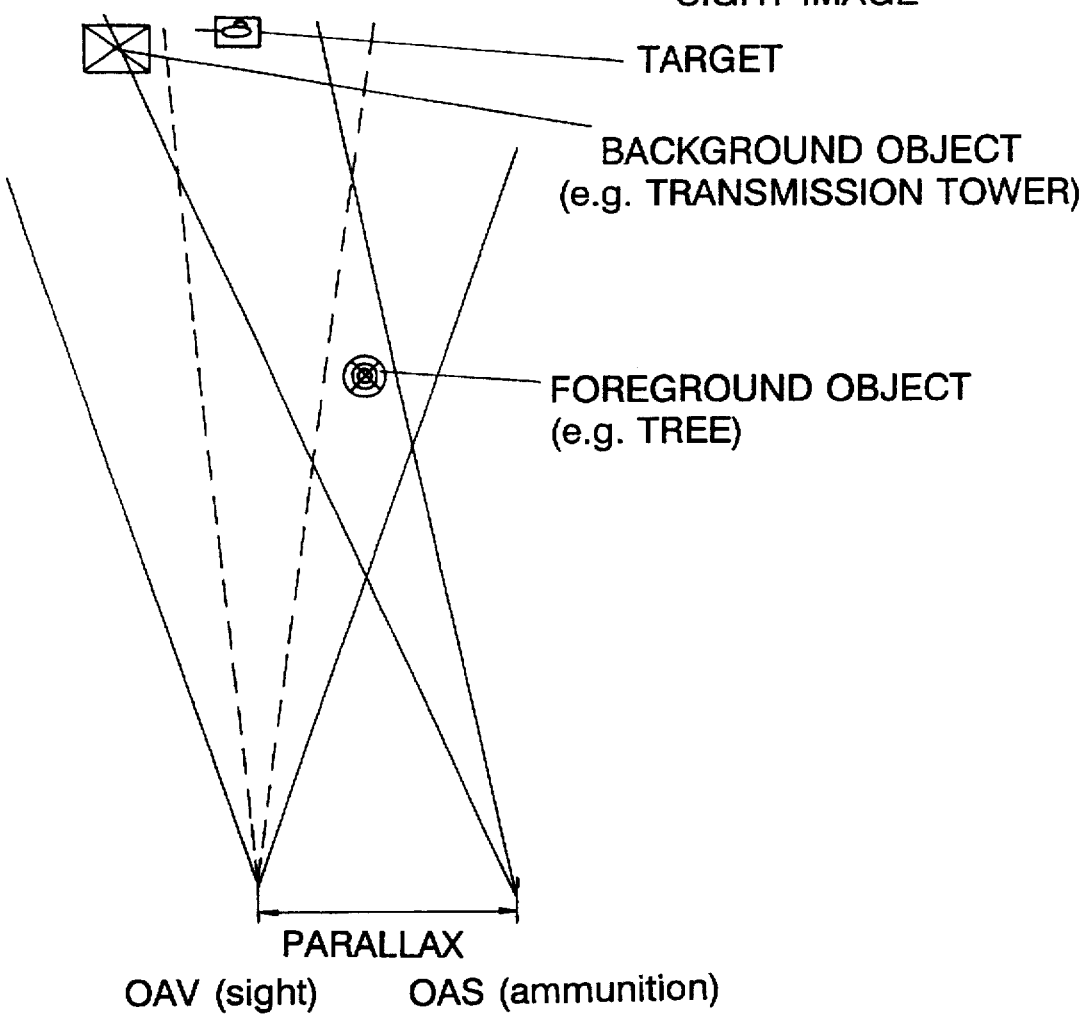
FIGURE 1C

MISSILE WEAPONS SYSTEM

FIELD OF THE INVENTION

The present invention pertains to a missile weapons system with a cardanically suspended homing head and with an alignment processor (tracker), which continuously determines its target by comparing sight and homing head images, which are brought to coincide, by means of a correlation process.

BACKGROUND OF THE INVENTION

Such weapons systems according to the so-called "fire and forget system" have been known per se. After being fired off, the missile in such systems is completely on its own during homing. It is equipped for this purpose with a cardanically suspended homing head camera and with a tracker, which tracks the target assigned to it by successive image comparison by means of a correlation method until it hits its target, and the homing head moves completely autonomously after firing and cannot be influenced. The target to be reached must, of course, be specified for the missile or its "alignment processor" prior to takeoff, or it must be aligned to the target. A so-called image comparison, in which images of the gun operator's sight are compared and correlated with those of the homing head, is used for this purpose. However, the visual field of the homing head is considerably smaller than that of the gun operator's sight, i.e., it sees only a detail of the larger sight image. The two images are continuously made to agree by the alignment processor, and the comparison is performed such that the sight image is polled line by line and column and column beginning from the top left corner of the homing head image, and the correlation coefficient or a related criterion is determined for each position. The probability that the two images are congruent is highest where the correlation coefficient has its maximum. Since the homing head has a fixed focus in the current state of the art, the gun operator cannot determine the image detail himself, but the homing head is forced to use "whatever it sees." The focal distance of the homing head optical system is dimensioned to be such that a normal tank target at a distance of 500 m—this is the minimum distance—still fits completely "into the image." However, this has the drawback that the target appears in a relatively very small form (about 4 samples) at the maximum distance of about 4–5 km. Consequently, the image also contains a considerable amount of background besides the target. The smaller the target, the more disturbing is this background.

However, the optical axis of the sight is located at a distance from the optical axis of the homing head, which is due to the carrier (helicopter), i.e., there is a parallax, which is about 5 m in height and width. The angle of view of the homing head toward the target consequently also differs from the angle of view from the sight. However, it is essential for the image comparison by the alignment processor that the homing head optic system and the sight optic system see the same thing. However, this does not happen if objects located in the foreground and the background are present in the image (FIG. 1*c*), which can be considered to be the normal case. This leads, however, to a considerable impairment of the image comparison and to a great alignment error.

U.S. Pat. No. 3,986,682 discloses a missile weapons system, in which a target is continuously tracked by the comparison of sight and homing head images, which are caused to coincide, by means of a correlation process, and the size of the image of the homing optic system is selected to be small from the beginning.

DE 33 34 729 A1 discloses a process for aligning a homing head of a self-guided missile, in which an image containing the target and an image generated by the homing head are adjusted to one another by means of image correlation.

SUMMARY AND OBJECTS OF THE INVENTION

The primary object of the present invention is to provide a weapons system of the type described in the introduction, in which the alignment probability of at least 85% is reached and guaranteed, and the alignment processor is nearly undisturbable by residual stabilization errors, and the harmonization near the ground and the resolution of the homing image are improved.

According to the invention, a missile weapons system is provided with a cardanically suspended homing head and with an alignment processor (tracker), which continuously determines its target by comparing sight and homing head images, which are brought to coincide, by means of a correlation process. The system includes a target marking frame in the sight image that can be adjusted to the size of the target by reduction or enlargement to reduce the effect of parallax on the correlation and is entered into the homing head optic system in the selected size. The homing head is provided with a zoom lens adapted to the range of the weapons system, which zoom lens reduces the visual field until the target is always represented in the coinciding image as a target that at least "nearly fills out the image" at all distances from the target. The vibration levels acting on the homing head or its zoom optic system are extensively eliminated by switching on the on-board background tracker. A value for the size of the correlation is preset for the target handover by adjusting the resolutions of the two sensors.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 1*a* is a sight image (front view) according to the invention;

FIG. 1*b* is a homing head image (front view) according to the invention;

FIG. 1*c* is a top view providing a setting comparison; and

DESCRIPTION OF THE PREFERRED EMBODIMENTS

Figure 2:
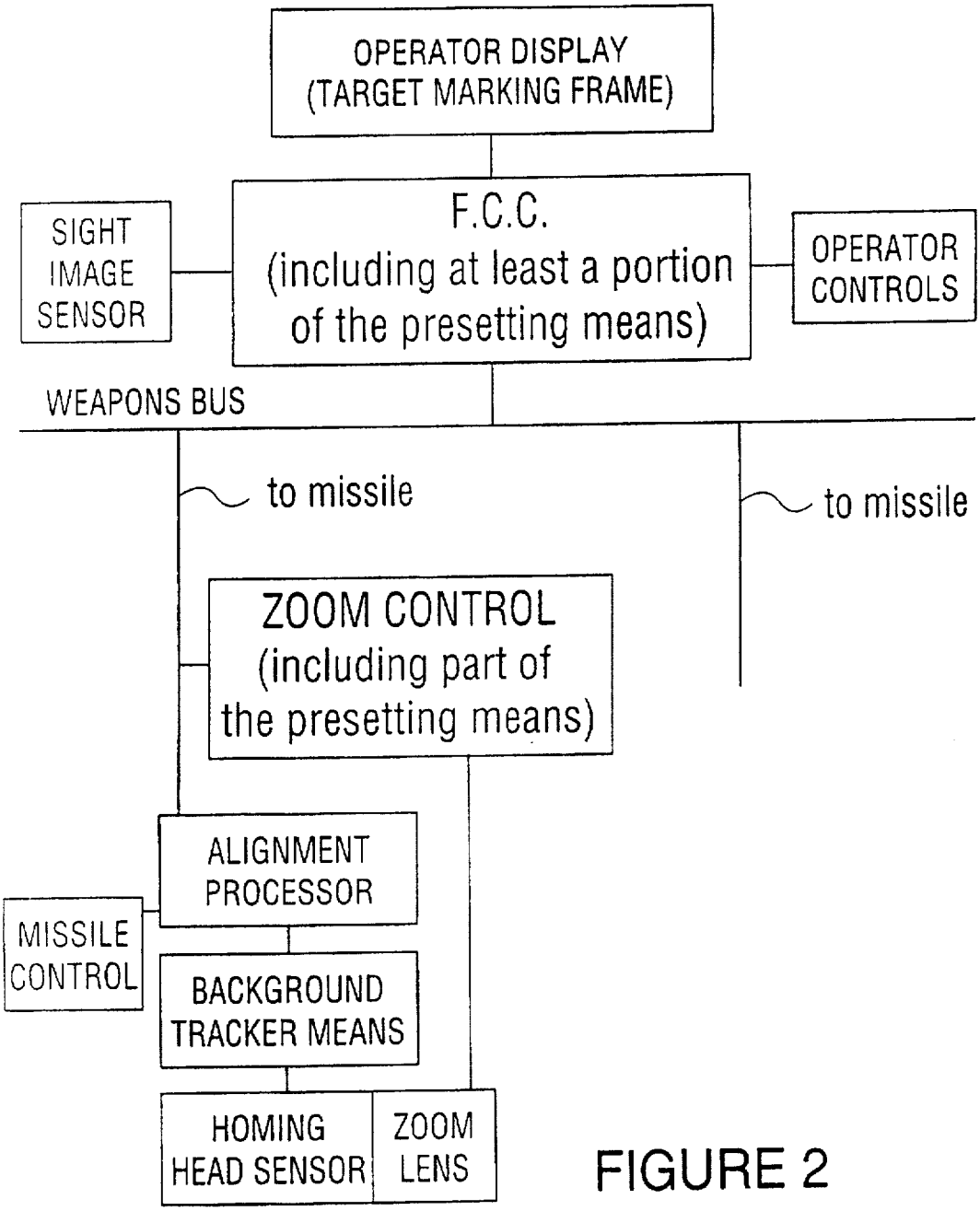
FIG. 2 is a schematic view of the apparatus according to the invention.

Referring to the drawings in particular, FIG. 1*a* shows a sight image, the gun operators sight. This sight image includes a target marking frame or box in the sight image that can be adjusted to the size of the target by reduction or enlargement to reduce the effect of parallax on the correlation (see FIG. 1*c*) and is entered into the homing head optic system in the selected size. The missile weapons system is provided with a cardanically suspended homing head and with an alignment processor (tracker), which continuously determines its target by comparing sight and homing head images, which are brought to coincide, by means of a correlation process. The homing head image is shown in FIG. 1*b*. The homing bead is provided with a zoom lens adapted to the range of the weapons system, which zoom lens reduces the visual field until the target is always represented in the coinciding image as a target that at least "nearly fills out the image" at all distances from the target. The vibration levels acting on the homing head or its zoom optic system are extensively eliminated by switching on the on-board background tracker. A value for the size of the correlation is preset for the target handover by adjusting the resolutions of the two sensors.

As is apparent from the above explanations, an optimal alignment probability can be achieved only if parallax-free images are present. This can be achieved by minimizing the surroundings of the target, i.e., the surroundings of the target are only slightly included in the image comparison at best. The marking box must therefore be adapted to the size of the target, i.e., it must be reduced or enlarged to the extent that the marking box will contain as little background as possible. The marking box is a display processor-generated, rectangular white frame, not drawn in solid line (in normal use but shown in solid line in FIG. 1*a*), with indicated corners. It is currently designed as a square frame, and its size is preset. The gun operator with this feature can either enlarge or reduce, so to speak, zoom, the marking box via the control elements (operator controls). The state of operation, i.e., "Enlarge" or "Reduce," is reported to the fire control computer (FCC) on the MIL bus. From the time for which the gun operator keeps the zoom key depressed and the zooming speed, the FCC (Fire Control Computer) calculates the current size of the marking box, which is reported to the tracker for setting the size of the track box by means of the FCC. By means of the reduced size of the visual field, which corresponds to the size of the marking box, and the known sensor dimension of the homing head, the FCC is able to calculate the actual focal distance of the homing head optic system and to report or enter it to the ammunition on the bus. The homing head adjusts its current actual value to the desired value commanded by the FCC and sends the size of the visual field currently reached to the FCC for each frame, until the computer finds the agreement. The control circuit can be maintained as long as the gun operator on his part adjusts the "operator controls."

However, it should be borne in mind in connection with the calculation of the focal distance that the homing head image is rotationally symmetrical, and only the part located within an inscribed square can be compared with the sight image detail. The sensor ratio must be taken into account geometrically by a factor $\sqrt{2}$.

It is more difficult to set an appropriate marking box size with moving targets, including the movements of the carrier, than with nonmoving targets and nonmoving carrier. The movements of the carrier are to be minimized by switching on the background tracker means, so that only the relative movement of the target is to be taken into account.

Once the correct marking box size has been found, this image detail must be compared with the detail of the homing head image, which latter detail is of the same size. It is now suggested that the homing head be provided for this purpose with a zoom lens, which is able to reduce the visual field until the target still "fills out the image" even at the maximum distance from the target. The corresponding visual field size is determined by the FCC (Fire Control Computer) via the weapons system bus.

"Filling out the image" does not mean that the target must fill out the entire image at the maximum distance. It is sufficient if good image comparison is guaranteed even for distant targets and it still permits sufficient detection even at increased vibration levels, to which a long-range optical system is exposed, contrary to the close-range optic system.

As a result, a weapons system is created which guarantees the desired, optimally high alignment probability and eliminates the previous effect of parallax on the correlation, and which also brings about substantial harmonization near the ground as well as improved resolution of the homing head image. The "image explosion," which brings about rapidly changing conditions especially during the final approach of the ammunition and unfavorably affects the algorithms, is shifted close to the "end time." The "target handover criterion" is also decisively improved because of the higher resolution of the zoom optic system.

While a specific embodiment of the invention has been shown and described in detail to illustrate the application of the principles of the invention, it will be understood that the invention may be embodied otherwise without departing from such principles.

What is claimed is:

1. A missile weapons system, comprising:

a missile with a homing head zoom optic system and a cardanically suspended homing head image sensor providing a homing head image;

a sight image sensor providing a sight image having an angle of view which is different from said homing head image;

an alignment processor (tracker), which continuously determines its target by comparing said sight image and said homing head image, said sight image and said homing head image being brought to coincide, by means of a correlation process;

a target marking frame in the sight image which is adjusted to the size of the target by reduction or enlargement to reduce the effect of parallax on the correlation, said target marking frame being entered into the homing head zoom optic system in the selected size;

a zoom lens, provided with said homing head zoom optic system said zoom lens being provided adapted to the range of the weapons system, said zoom lens reducing a visual field of said homing head image until the target is always represented in the coinciding homing head image as a target that at least nearly fills out the image at all distances from the target;

background tracker means including an on-board background tracker, said background tracker means for substantially eliminating the vibration levels acting on the homing head or its zoom optic system by switching on said on-board background tracker; and presetting means for presetting a value for the size of the correlation for a target handover by adjusting the resolutions of the homing head image sensor and sight image sensor.

2. A process for a missile weapons system, comprising:

providing a missile with a homing head zoom optic system and a cardanically suspended homing head sensor providing a homing head image;

providing a sight image having an angle of view which is different from said homing head image;

continuously determining a target by comparing said sight image and said homing head image, which are brought to coincide, by means of a correlation process;

providing a target marking frame in the sight image which is adjusted to the size of the target by reduction or enlargement to reduce the effect of parallax on the correlation, said target marking frame being entered into the homing head zoom optic system in the selected size;

providing a zoom lens with said homing head zoom optic system said zoom lens being provided adapted to the range of the weapons system;

with said zoom lens reducing a visual field of said homing head image until the target is always represented in the coinciding homing head image as a target that at least nearly fills out the image at all distances from the target;

substantially eliminating the vibration levels acting on the homing head sensor or said homing head zoom optic system by switching on an on-board background tracker; and presetting a value for the size of the correlation for a target handover by adjusting the resolutions of the homing head image sensor and sight image sensor.

* * * * *